US005649835A

United States Patent [19]

Weed

[11] Patent Number: 5,649,835

[45] Date of Patent: Jul. 22, 1997

[54] ELECTRICAL PLUG ASSEMBLY WITH COUPLING MECHANISM

[76] Inventor: Frederick D. Weed, P.O. Box 386, Cottonwood, Ariz. 86326

[21] Appl. No.: 564,484

[22] Filed: Nov. 29, 1995

[51] Int. Cl.[6] ..... H01R 4/38

[52] U.S. Cl. ..... 439/320; 439/369; 439/373

[58] Field of Search ..... 439/312, 313, 439/320, 321–323, 536, 562, 369, 373

[56] References Cited

U.S. PATENT DOCUMENTS 3,656,083 4/1972 Brook ..... 439/373 X
4,531,800 7/1985 Avener ..... 439/373
5,211,570 5/1993 Bitney ..... 439/320
5,454,728 10/1995 Jack ..... 439/320 X

*Primary Examiner*—Khiem Nguyen

[57] ABSTRACT

An electrical plug assembly with coupling mechanism including a male plug with helical grooves formed therein. Further included is a female plug having a radially outward extending flange formed therein at a front end thereof and a detent formed therebehind. An annular sleeve comprising a radially inward extending flange is formed in a rear end thereof for slidably rotating between the flange and detent of the female plug. Finally, helical grooves are formed in an inner surface of the sleeve at a front end thereof for screwably coupling with the helical grooves of the male plug.

1 Claim, 3 Drawing Sheets

ELECTRICAL PLUG ASSEMBLY WITH COUPLING MECHANISM

BACKGROUND OF THE INVENTION

1. Field of the Invention

The present invention relates to an electrical plug assembly with coupling mechanism and more particularly pertains to securing a male plug to a female plug.

2. Description of the Prior Art

The use of electrical plugs is known in the prior art. More specifically, electrical plugs heretofore devised and utilized for the purpose of connecting electrical control lines are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 5,167,527 to Clark discloses an electrical plug assembly providing internal, adjustable gripping means and sealing means for electrical cords of various sizes. U.S. Pat. No. 5,133,671 to Boghosian discloses a combined releasable holder and lock for electrical connections including elongated locking straps. U.S. Pat. No. 5,348,495 to Kasden discloses an electrical cord plug lock assembly. Lastly, U.S. Pat. No. 5,211,573 to Cross and U.S. Pat. No. 5,129,836 to Ursich are provided as being of general interest.

In this respect, the electrical plug assembly with coupling mechanism according to the present invention substantially departs from the conventional concepts and designs of the prior art, and in so doing provides an apparatus primarily developed for the purpose of securing a male plug to a female plug.

Therefore, it can be appreciated that there exists a continuing need for a new and improved electrical plug assembly with coupling mechanism which can be used for securing a male plug to a female plug. In this regard, the present invention substantially fulfills this need.

SUMMARY OF THE INVENTION

In view of the foregoing disadvantages inherent in the known types of electrical plugs now present in the prior art, the present invention provides an improved electrical plug assembly with coupling mechanism. As such, the general purpose of the present invention, which will be described subsequently in greater detail, is to provide a new and improved electrical plug assembly with coupling mechanism apparatus and method which has all the advantages of the prior art and none of the disadvantages.

To attain this, the present invention essentially comprises a male plug with a front section with a cylindrical configuration. The front section has helical grooves formed therein at a front end thereof. The male plug also has a rear section comprising a conical configuration. The male plug further comprises a planar front face with a pair of rectangular contact strips and a grounding post extending outwardly therefrom.

Also included is a female plug comprising a front section with a cylindrical configuration. The front section has an radially outward extending flange formed therein at a front end thereof. A detent is formed therein at a central extent of the periphery of the front section behind the flange. The female plug further includes a rear section having a conical configuration. The female plug also includes a planar front face with a pair of rectangular contact apertures for releasably receiving the contact strips and a ground aperture for releasably receiving the ground aperture of the male plug. An annular sleeve comprises a radially inward extending flange formed in a rear end thereof for slidably rotating between the flange and detent of the female plug. Finally, helical grooves are formed in an inner surface thereof at a front end thereof for screwably coupling with the helical grooves of the male plug.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved electrical plug assembly with coupling mechanism which has all the advantages of the prior art electrical plugs and none of the disadvantages.

It is another object of the present invention to provide a new and improved electrical plug assembly with coupling mechanism which may be easily and efficiently manufactured and marketed.

It is a further object of the present invention to provide a new and improved electrical plug assembly with coupling mechanism which is of a durable and reliable construction.

An even further object of the present invention is to provide a new and improved electrical plug assembly with coupling mechanism which is susceptible of a low cost of manufacture with regard to both materials and labor, and which accordingly is then susceptible of low prices of sale to the consuming public, thereby making such electrical plug assembly with coupling mechanism economically available to the buying public.

Still yet another object of the present invention is to provide a new and improved electrical plug assembly with coupling mechanism which provides in the apparatuses and methods of the prior art some of the advantages thereof, while simultaneously overcoming some of the disadvantages normally associated therewith.

Still another object of the present invention is to secure a male plug to a female plug.

Lastly, it is an object of the present invention to provide a new and improved electrical plug assembly with coupling mechanism including a male plug with helical grooves formed therein. Further included is a female plug having a radially outward extending flange formed therein at a front end thereof and a detent formed therebehind. An annular sleeve comprising a radially inward extending flange is formed in a rear end thereof for slidably rotating between the flange and detent of the female plug. Finally, helical grooves are formed in an inner surface of the sleeve at a front end thereof for screwably coupling with the helical grooves of the male plug.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
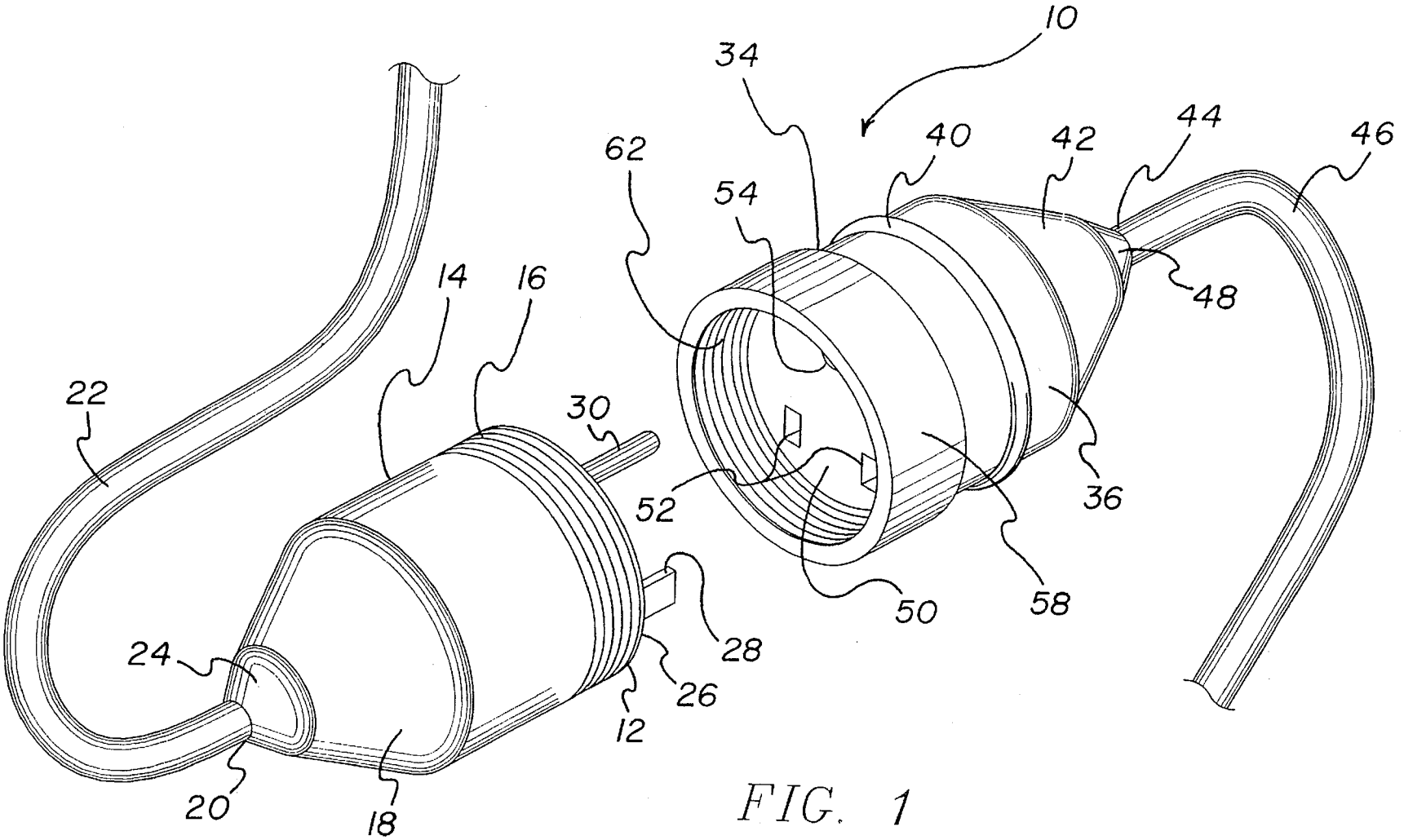
FIG. 1 is a perspective illustration of the preferred embodiment of the electrical plug assembly with coupling mechanism constructed in accordance with the principles of the present invention.
Figure 2:
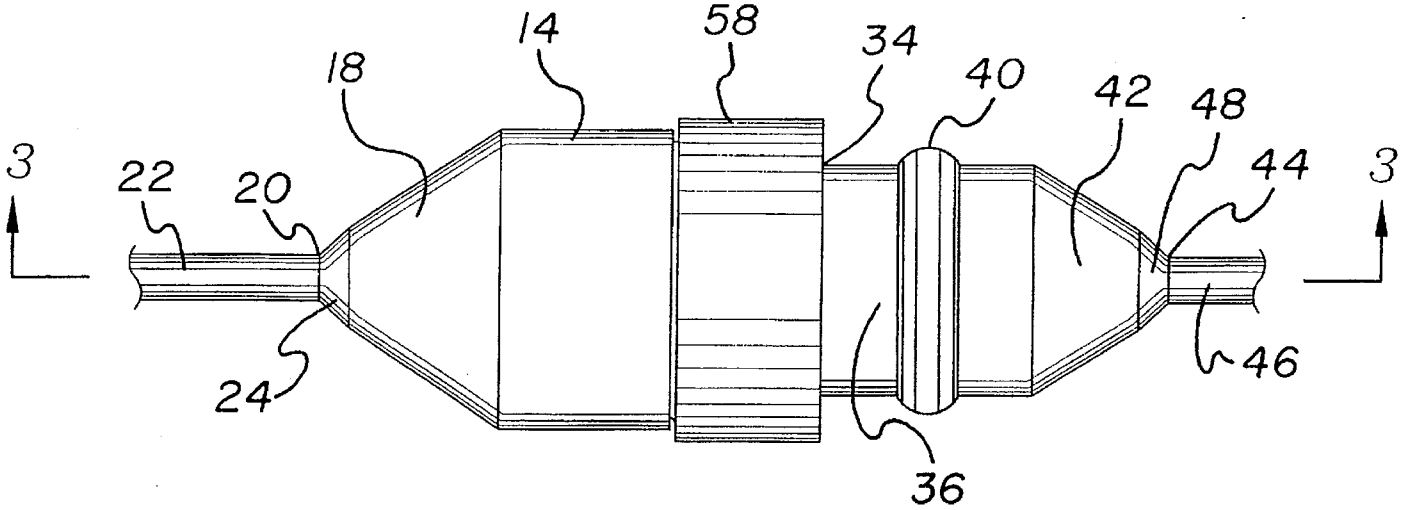
FIG. 2 is a plan side view of the present invention.
Figure 3:
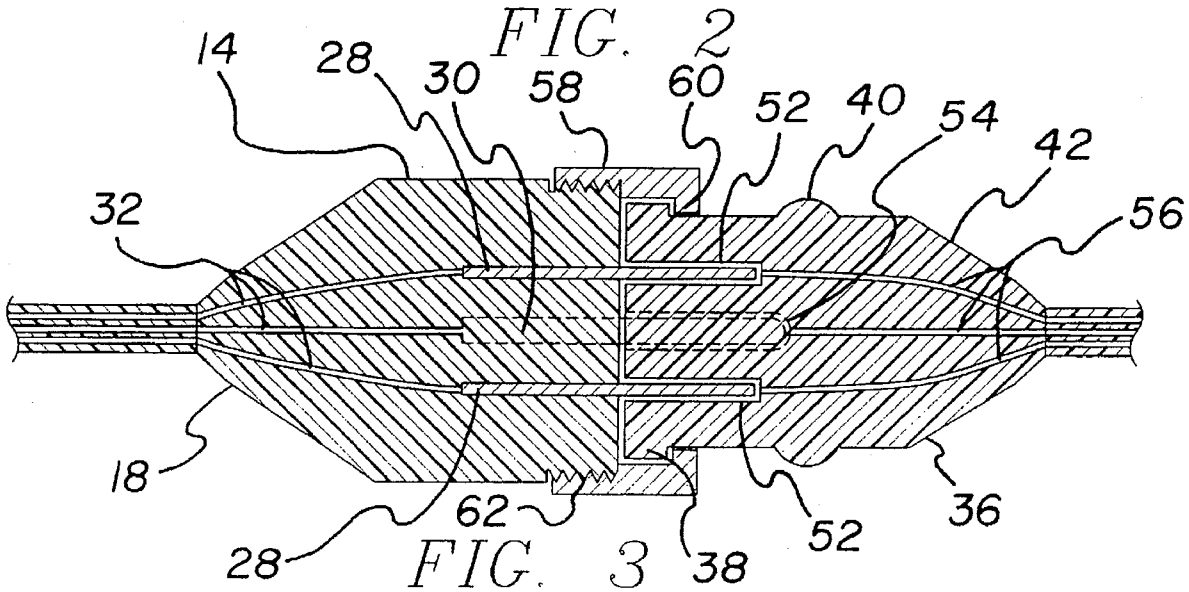
FIG. 3 is a cross-sectional view taken along Line 3—3 of FIG. 2.

With reference now to the drawings, and in particular to FIG. 1 thereof, a new and improved electrical plug assembly with coupling mechanism embodying the principles and concepts of the present invention and generally designated by the reference numeral 10 will be described.

The present invention, the new and improved electrical plug assembly with coupling mechanism, is comprised of a plurality of components. Such components in their broadest context include a male plug and female plug. Such components are individually configured and correlated with respect to each other so as to attain the desired objective.

More specifically, it will be noted that the system 10 of the present invention includes a male plug 12 comprising a front section 14 with a cylindrical configuration. The front section has helical grooves 16 formed therein at a front end thereof. The male plug also has a rear section 18 comprising a conical configuration with an axially aligned aperture 20 formed in a rear end thereof. A cord 22 is situated within the aperture with a grommet 24 coupled thereabout. The grommet 24 prevents the cord 22 from being detached. The male plug further comprises a planar front face 26 with a pair of rectangular contact strips 28 and a grounding post 30 extending outwardly therefrom. Finally, three control lines 32 are connected to the contact strips and grounding post. The control lines extend through the front and rear section to the cord. The male plug is preferably formed of an insulative, elastomeric material.

Also included is a female plug 34 comprising a front section 36 with a cylindrical configuration. The diameter of the front section of the female plug is smaller than the front section of the male plug. The front section has a radially outward extending flange 38 formed therein at a front end thereof. A detent 40 is formed in a central extent of the periphery of the front section behind the flange. The female plug further includes a rear section 42 having a conical configuration with an axially aligned aperture 44 formed in a rear end thereof. A cord 46 is situated within the aperture with a grommet 48 coupled thereabout. The grommet 48 prevents the cord 46 from being detached. The female plug also includes a planar front face 50 with a pair of rectangular contact apertures 52 for releasably receiving the contact strips and a ground aperture 54 for releasably receiving the grounding post. The contact strips and ground aperture have a triangular configuration. Three control lines 56 are connected to the contact apertures and the grounding aperture. The control lines extend through the front and rear section. An annular sleeve 58 comprises a radially inward extending flange 60 formed in a rear end thereof for slidably rotating between the flange and detent of the female plug. Finally, helical grooves 62 are formed in an inner surface thereof at a front end thereof for screwably coupling with the helical grooves of the male plug. The female plug is preferably formed of a insulative, elastomeric material.

Figure 4:
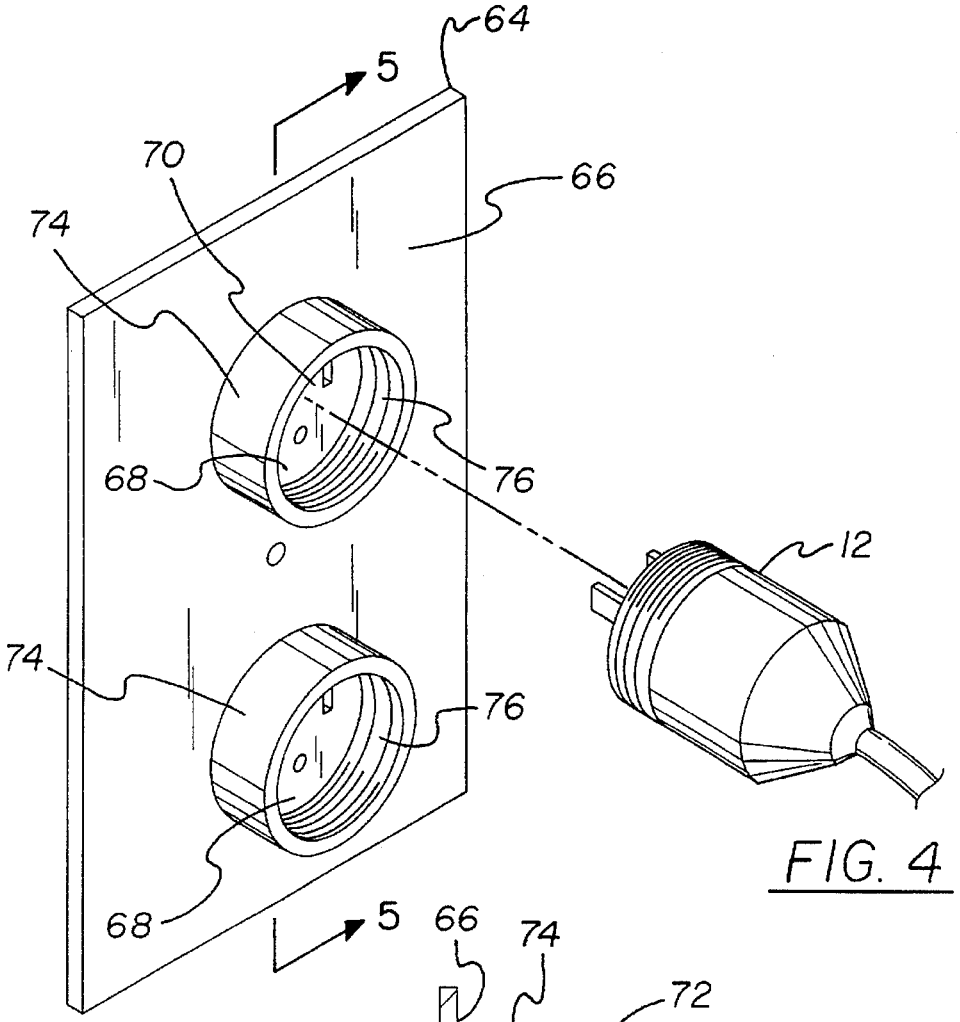
FIG. 4 is perspective illustration of an alternate embodiment of the present invention.
Figure 5:
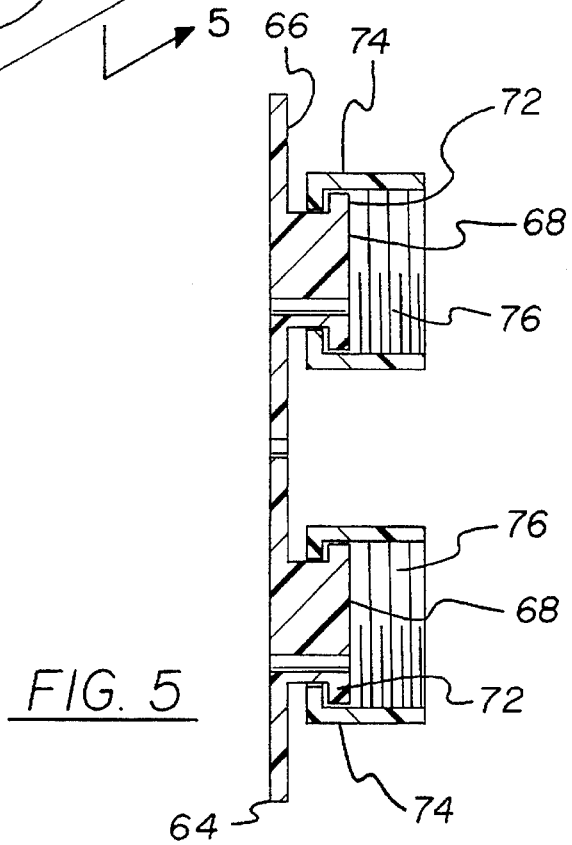
FIG. 5 is a cross-sectional view taken along the Line 5—5 shown in FIG. 4.

An alternate embodiment, as shown in FIG. 4 & 5, includes the male plug 12 as described hereinabove and further a wall socket cover 64. The wall socket cover comprises a planar surface 66 and a pair of cylindrical protrusions 68 formed thereon with a pair of plug outlets 70 situated therein. Each annular protrusion has an outwardly extending flange 72 formed therein at an outboard end thereof. Also included is an annular sleeve 74 comprising a radially inward extending flange formed in a rear end thereof for slidably rotating between the flange and planar surface of the wall socket cover. Finally, helical grooves 76 are formed in an inner surface of the sleeve at a front end thereof for screwably coupling with the helical grooves of the male plug.

The present invention provides a coupling mechanism for securing a male plug with a female plug or a male plug with a wall socket cover. Such a device prevents inadvertent disconnecting of the plugs thus affording assured continuity of the control lines and an additional safety measure.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved electrical plug assembly with coupling mechanism, comprising, in combination:

a male plug comprising a front section with a cylindrical configuration, the front section having helical grooves formed therein at a front end thereof; a rear section having a conical configuration with an axially aligned aperture formed in a rear end thereof; a cord situated within the aperture with a grommet coupled about the cord, the grommet preventing detaching of the cord; a planar front face with a pair of rectangular contact strips and a grounding post extending outwardly therefrom; and three control lines connected to the contact strips and grounding post and extending through the front and rear section to the cord; and a female plug comprising a front section with a cylindrical configuration, the front section having a radially outward extending flange formed therein at a front end thereof and an annular detent formed therebehind; a rear section having a conical configuration with an axially aligned aperture formed in a rear end thereof; a cord situated within the aperture with a grommet coupled about the cord, the grommet preventing detaching of the cord; a planar front face with a pair of rectangular contact apertures for releasably receiving the rectangular contact strips of the male plug and a ground aperture for releasably receiving the grounding post; three control lines connected to the contact apertures and a grounding aperture and extending through the front and rear section; and an annular sleeve comprising a radially inward extending flange formed in a rear end thereof for slidably rotating between the flange and detent of the female plug and helical grooves formed in an inner surface thereof at a front end thereof for screwably coupling with the helical grooves of the male plug.

* * * * *